US005286029A

United States Patent [19]

Smit

[11] Patent Number: 5,286,029

[45] Date of Patent: Feb. 15, 1994

[54] GOLF PRACTICE APPARATUS

[76] Inventor: Hendrik P. Smit, P.O. Box 10056, Springs, Transvaal, South Africa

[21] Appl. No.: 84,013

[22] Filed: Jun. 29, 1993

[51] Int. Cl.[5] ..... A63B 69/36

[52] U.S. Cl. ..... 273/181 F; 273/410

[58] Field of Search ..... 273/26 R, 26 A, 29 A, 273/29 B, 181 R, 181 A, 181 F, 410, 411

[56] References Cited

U.S. PATENT DOCUMENTS

| | | | |
|---|---|---|---|
| 1,527,988 | 3/1925 | McMurtrie | 273/181 F X |
| 2,455,185 | 11/1948 | May | 273/181 A |
| 2,458,105 | 1/1949 | Sell | 273/181 A |
| 2,815,955 | 12/1957 | Dear | 273/410 |
| 2,819,901 | 1/1958 | Mateja | 273/26 A |
| 3,918,711 | 11/1975 | Zak | 273/26 A X |
| 4,733,865 | 3/1988 | Reed | 273/26 A |
| 4,880,239 | 11/1989 | Leneveu | 273/181 F |
| 5,064,194 | 11/1991 | Bixler et al. | 273/26 A |

*Primary Examiner*—William Stoll

*Attorney, Agent, or Firm*—Bell, Seltzer, Park & Gibson

[57] ABSTRACT

Golf practice apparatus is for use in the practice of chip shots. The apparatus includes a bin formed of a fabric or fabric-like material, and wings which extend laterally to either side of the bin which are designed as catch fences for wayward balls. A frame is provided for supporting the bin in an erected condition, and the apparatus may be collapsed and rolled up into a bundle for storage when not in use.

7 Claims, 2 Drawing Sheets

FIG 3
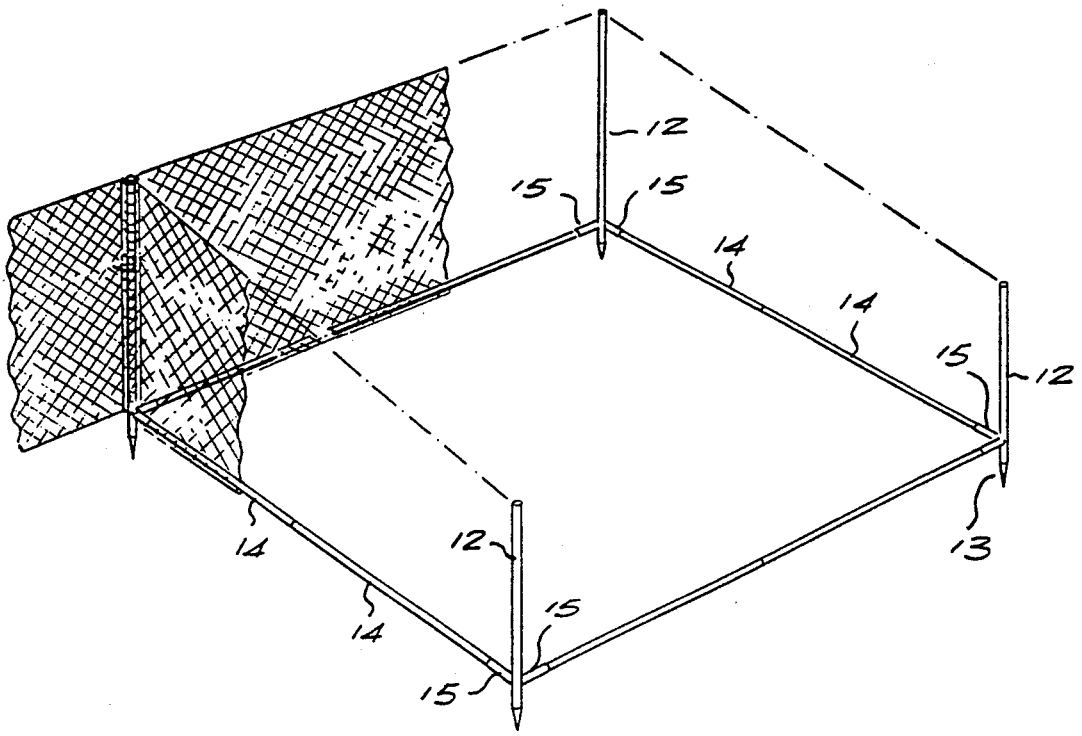
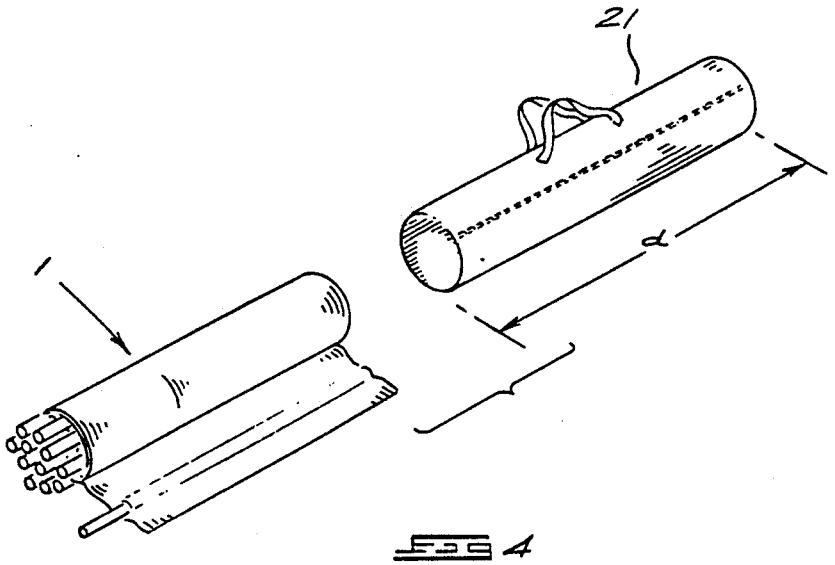
FIG 4

GOLF PRACTICE APPARATUS

BACKGROUND TO THE INVENTION

THIS invention relates to a golf practice apparatus, and more particularly, to practice apparatus with which a user can practice his or her chipping.

Golf nets are well known and are used by golfers to practice their swings. Such nets are generally adapted to absorb impact of a firmly struck golf ball to thereby retain the golf ball and prevent it causing damage or becoming lost in confined or built-up areas.

A problem with conventional golf nets is that a user has no real way of knowing how the ball will travel or fly after it has been struck. As any golfer will know, a golf ball struck with any lateral spin will tend to veer off to the left or right resulting in a ball which has apparently been well struck ending up way off the intended line of flight.

Many persons who would like to practice golf have insufficient space to enable them to practice relatively short golf shots such as would be used, in a game, to chip onto the golf green from adjacent areas. Chipping is, of course, an important feature of the game golf and the player who can chip well will generally score well. In order to practice chipping a player needs to be able to see the flight of the ball after it has been struck so that distance and accuracy of chips can be gauged. Prior art catch-net type practice devices are not capable of providing this visual feedback to the practising golfer in any meaningful way.

U.S. Pat. No. 4,336,939 discloses a complex clip and putting apparatus which is suitable for permanent installation in a golf practice facility, but is unsuitable for a golfer who wishes to practice chip shots at his or her local park or sports field with a minimum of fuss. The apparatus shown in that patent is also costly and accordingly unsuitable for single home practice usage.

SUMMARY OF THE INVENTION

Golf practice apparatus according to the invention is for use in the practice of chip shots by a user, the apparatus being erectable into an erected configuration and collapsible into a collapsed configuration, the apparatus comprising:

- a bin formed of a fabric or fabric-like flexible material, said bin when in the erected configuration being of generally rectangular shape and having a front wall, two side walls, a rear wall, and a base, the front wall being lower than the rear wall and the side walls having an upper edge which inclines from the front wall to the rear wall;
- a frame for supporting the bin in its erected configuration, said frame being formed of releasably interconnected frame elements;
- a pair of wings connected to or integral with the rear wall and when in the erected configuration extending laterally to each side of the bin to form a catch fence on either side of the bin;
- the apparatus being collapsible into its collapsed configuration by disconnecting the frame elements from each other and removing the bin from the frame to enable the bin and wings to be folded or rolled into a compact bundle.

The size of the bin can vary between a small size of approximately 1 $m^2$ to a large size of approximately 10 $m^2$.

The base is preferably suspended off the ground so that balls which are chipped into the bin and land on the base have some of the momentum absorbed by the base so that the golf balls are thereby contained within the bin.

An embodiment of the invention is described in detail in the following passages of the specification which refer to the accompanying drawings. The drawings, however, are merely illustrative of how the invention might be put into effect, so that the specific form and arrangement of the various features shown is not to be considered to be limiting on the invention.

BRIEF DESCRIPTION OF THE DRAWINGS

FIG. 3 shows a perspective view of the frame for the apparatus shown in FIG. 1; and FIG. 4 shows a perspective view of the apparatus in a collapsed configuration.

DETAILED DESCRIPTION OF THE PREFERRED EMBODIMENTS

Figure 1:
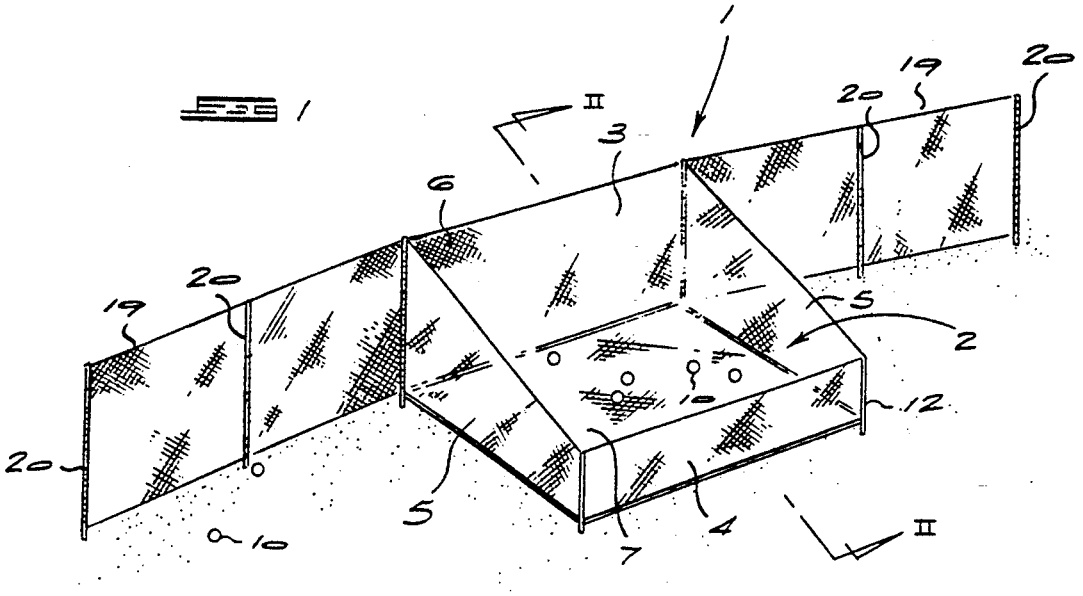
FIG. 1 shows a perspective view of golfing apparatus according to the invention.
Figure 2:
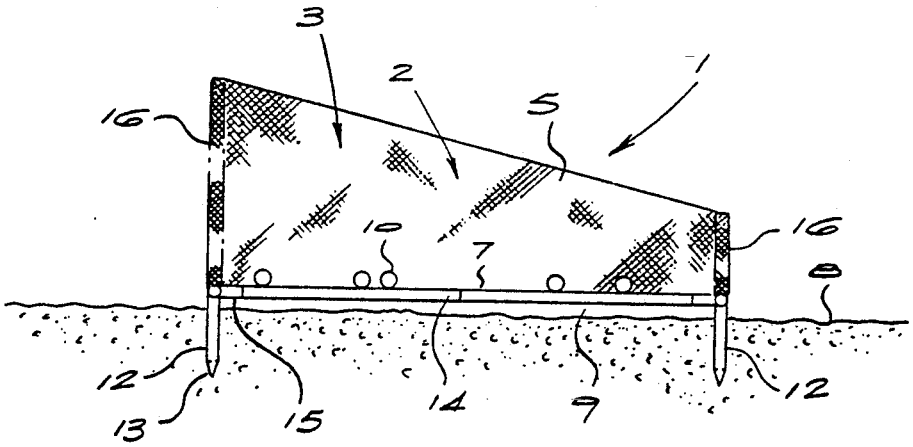
FIG. 2 shows a cross-sectional view along line 2—2 shown in FIG. 1.

Referring initially to FIGS. 1 and 2 golfing apparatus 1 according to the invention includes a bin 2 which is substantially square in plan view having four equal length wall of approximately 1 m in length. Thus, the bin 2 has a floor area of approximately 1 $m^2$. FIG. 1 shows the apparatus in an erected configuration, but is easily collapsible and stowable as will be described in more detail below.

The bin 2 has upstanding walls 3 which are made of an impact absorbing material such as fabric or netting, preferably netting, which is capable of having a golf ball strike a wall and have the energy of a golf ball absorbed by the wall material. A relatively loosely hung netting material will serve this function. In the preferred arrangement the netting from which the walls 3 are made has relatively large net openings although not so large as to allow a golf ball to pass through. Thus, the net openings will have a diameter when stressed of less than the diameter of a golf ball.

The bin 2 has a front wall 4, side walls 5 and a rear wall 6. The front wall 4 is lower than the rear wall 6 and the side walls 5 are inclined upwardly from the top of the front wall 4 to the top of the rear wall 6. The height of the front wall 4 may be approximately 200 mm and the height of the rear wall 6 may be approximately 500 mm. However, it will be understood that different arrangements are possible and indeed the rear wall 6 may in practice be considerably higher than 500 mm.

The bin is provided with a base 7 which joins to the side walls 3, at the lower edges of the side walls 3. The base 7 may, as shown in FIG. 2, be spaced away from the ground 8 so that a gap 9 is defined between the base 7 and the ground 8. This gap 9 will ensure that when a golf ball 10 lands on the base 7 there will be a certain "give" in the base to thereby absorb the energy of the golf ball 10 and ensure that the golf ball does not bounce out of the bin. This would be particularly important where the bin was mounted on a hard surface such as a concrete slab or the like.

The walls 3 are supported in an erect or upstanding condition by a frame. That frame can be of any convenient configuration and in its simplest form would comprise four upstanding poles 12 which have a sharpened lower tip 13 for insertion into the ground. Preferably there are at least lower inter-connecting frame elements 14 which connect together the adjacent vertical corner members 12 and hold the assembly in its box-like form.

FIG. 3 shows the preferred form of frame. The frame as shown comprises the four corner poles 12 each of which has a pair of orthogonally extending connecting sockets 15 near its lower end. A rectangular horizontal sub-frame 14 connects into the sockets 15. The sub-frame 14 is formed of releasably interconnectable frame elements 17 and the connection between the frame elements 14 and the corner poles 12. This stabilizes the assembly in its erected condition.

The bin 2 has a vertically extending pocket 16 formed at each corner thereof on the outside of the bin. These pockets 16 are configured to receive the upstanding corner poles 12 so that the corner poles 12 serve to hold the walls erect and, preferably, the base 7 off the ground.

The bin has a catch-net 18 associated therewith. The catch-net 18 is in the form of a pair of wings 19 extending laterally from each side of the rear wall 6 as shown and is held in its erected condition by a series of support poles 20 which are spaced apart along the wings 19. The support poles 20 may be inserted into the ground so as to form a fence which runs on each side of the bin 2 in order to catch wayward golf balls struck by a user of the apparatus which do not land within the bin.

It is important that the whole assembly is easily and quickly stowable. The frame elements 14 are easily disconnectable from the corner poles 12 and the bin is easily removable from the frame simply by lifting it off the frame. The assembly thus can be collapsed in a relatively short time and rolled up for easy stowage. FIG. 4 shows the assembly 1 in its rolled up (i.e. collapsed) configuration. A carry-bag 21 is provided for easy transportation of the collapsed assembly. Since the frame elements 14 are preferably 1 m long, the bag should be of approximately that length (i.e. dimension line "d" shown in FIG. 4 should be slightly longer that the length of the frame elements 14.) The collapsed bundle in its carry-bag 21 can easily be stowed and transported in the trunk of a motor car.

Clearly many variations may be made to the above described embodiments without departing from the scope of the invention. In particular, the configuration of frame to hold the walls erect can differ from that described herein.

I claim:

1. Golf practice apparatus for use in the practice of chip shots by a user, the apparatus being erectable into an erected configuration and collapsible into a collapsed configuration, the apparatus comprising:

a bin formed of a fabric or fabric-like flexible material, said bin when in the erected configuration being of generally rectangular shape and having a front wall, two side walls, a rear wall, and a base, the front wall being lower than the rear wall and the side walls having an upper edge which inclines from the front wall to the rear wall;

a frame for supporting the bin in its erected configuration, said frame being formed of releasably interconnected frame elements;

a pair of wings connected to or integral with the rear wall and when in the erected configuration extending laterally to each side of the bin to form a catch fence on either side of the bin;

the apparatus being collapsible into its collapsed configuration by disconnecting the frame elements from each other and removing the bin from the frame to enable the bin and wings to be folded or rolled into a compact bundle.

2. Golf practice apparatus according to the claim 1 wherein the frame includes at least four operatively vertical corner members each having a lower end adapted to be inserted into the ground in use to secure the apparatus in its erected configuration.

3. Golf practice apparatus according to claim 2 wherein the frame in its erected configuration further includes a rectangular and generally horizontal sub-frame dimensioned to generally the same dimensions as the base, said sub-frame being comprised of frame elements which connect perpendicularly to the corner members.

4. Golf practice apparatus according to claim 3 wherein the bin has four vertically extending pockets, each pocket being located at the interface between adjacent walls, said pockets being dimensioned to receive the corner members in the erected configuration.

5. Golf practice apparatus according to claim 1 wherein the bin includes a series of pockets in the edge regions of at least some of the walls, said frame being insertable into the pockets to connect the frame to the bin in the erected configuration.

6. Golf practice apparatus according to claim 1 wherein the frame is located generally outside of the bin when in the erected configuration.

7. Golf practice apparatus according to claim 1 wherein the base is suspended off the ground when the apparatus is in its erected configuration.

* * * * *